United States Patent [19]

Livingstone

[11] 4,362,491

[45] Dec. 7, 1982

[54] TABLET MAKING MACHINES

[75] Inventor: David Livingstone, Royston, England

[73] Assignee: Ed Frogerais SA, France

[21] Appl. No.: 305,609

[22] Filed: Sep. 25, 1981

[30] Foreign Application Priority Data

Feb. 5, 1981 [GB] United Kingdom ..... 8103586

[51] Int. Cl.[3] ..... B28B 17/00; B30B 11/08

[52] U.S. Cl. ..... 425/186; 425/193

[58] Field of Search ..... 425/186, 193, 185

[56] References Cited

U.S. PATENT DOCUMENTS

| | | | |
|---|---|---|---|
| 2,289,671 | 7/1942 | McGinnis et al. | 425/186 X |
| 2,514,486 | 7/1950 | Green | 425/185 |
| 3,140,513 | 7/1964 | Campbell et al. | 425/193 X |
| 3,744,950 | 7/1973 | Courtois | 425/186 |
| 3,792,947 | 2/1974 | Diehl | 425/193 X |
| 4,053,267 | 10/1977 | DeSantis | 425/193 X |
| 4,134,716 | 1/1979 | John, Jr. | 425/186 |
| 4,167,380 | 9/1979 | Stüben et al. | 425/186 X |

*Primary Examiner*—Philip E. Anderson
*Attorney, Agent, or Firm*—Nelson E. Kimmelman

[57] ABSTRACT

A tablet making machine includes a rotor, one end, preferably the lower end, of which is detachably secured to a rotatable member of the machine so that the rotor rotates with the rotatable member in use of the machine; the configuration of the rotor being such that when it is detached from the rotatable member the rotor can be removed from the machine by generally horizontal sliding movement. The rotor may thus be easily and quickly removed from the machine by detaching the rotor from the rotatable member and sliding the rotor horizontally from the machine, thus significantly reducing the time taken to clean the machine between batches of tablets may be reduced and enabling ready replacement of punches and/or dies that are damaged or worn. Further, an alternative rotor with different punches can be substituted very quickly. In this way, machine downtime may be significantly reduced.

10 Claims, 2 Drawing Figures

TABLET MAKING MACHINES

1. Field of invention

This invention relates to a tablet making machine, and is concerned particularly with a rotor for such a machine.

2. Background to the invention

Tablets are formed by compressing a small quantity of powder under very high pressure in a defined space. The powder then becomes compacted into a solid of the same shape as this space. In practice this is done by filling a cylindrical cavity, the bottom of which is defined by a moveable piston, with powder. Another moveable piston above the cavity when descends compressing the powder, which is constrained by the cavity wall, against the lower moveable piston. When compression is complete both pistons move upwards until the tablet is ejected from the top of the cylindrical cavity.

In commercial tablet making the cylinder is called a die and the moving pistons are punches. The materials and general engineering approach relate closely to machine tool practice. A common arrangement is to mount several dies, with their associated upper and lower punches, round the periphery of a rotor. As the rotor rotates the heads of the punches slide on tracks which control the vertical position of the punches. These tracks are effectively face cams but are known as ramps. At the points of maximum pressure the punch heads are supported by rollers.

When a pharmaceutical company, manufacturing tablets, reaches the end of a batch of tablets the tablet making machine must be scrupulously cleaned in the tablet making area. This typically takes 8 hours in conventional tablet making machines. The rotor is normally mounted on a central pillar with, typically, a taper rolling bearing at the top and at the bottom. This pillar is firmly mounted at each end. Consequently, to remove the rotor a major machine strip down is required, which requires valuable time and labour.

It is accordingly an object of the present invention to provide an alternative rotor for a tablet making machine which can be more easily and quickly removed.

The invention

In accordance with the present invention there is provided a rotor for a tablet making machine, characterised in that one end of the rotor is adapted to be detachably secured to a rotatable member of the machine so that the rotor rotates with the rotatable member in use of the machine; the configuration of the rotor being such that when it is detached from the rotatable member the rotor can be removed from the machine by generally horizontal sliding movement.

Such a rotor when fitted in a tablet making machine may thus be easily and quickly removed therefrom by detaching the rotor from the rotatable member and sliding the rotor horizontally from the machine.

By enabling such easy and quick removal of a rotor from a tablet making machine, so the time taken to clean the machine between batches of tablets may be reduced. Further, a rotor may be readily removed for replacing punches and/or dies that are damaged or worn. In addition, if desired, an alternative rotor with different punches can be substituted very quickly. In this way, machine downtime may be significantly reduced.

Any suitable means may be provided for detachably securing the rotor to the rotatable member. These conveniently comprise a plurality, e.g. 6, screws for passing through suitably located bores in the rotatable member and into aligned holes in the rotor. Such screws preferably have large knurled heads to facilitate quick removal by hand. Furthermore, the screw heads may to advantage include one or more radial bores for receiving a bar to facilitate attachment and removal. If desired, one or more locating dowels or like members may be provided for seating in appropriate recesses in the rotor and rotatable member to assist in correctly locating the rotor with respect to the rotatable member during fitting.

Preferably the lower end of the rotor is adapted to be detachably secured to the rotatable member, thus facilitating fitting and removal.

If desired, a guide may be provided for supporting the opposed end of the rotor (ie the upper end in preferred embodiments) with respect to the machine. This may conveniently be in the form of an axially moveable spigot mounted on a frame of the machine, the spigot being moveable between an extended position of use in which it is located in a recess in the associated end face of the rotor, contact between the spigot and rotor being via suitable bearing means, and a retracted position in which it is free of the rotor so that removal of the rotor by horizontal sliding as discussed above is not hindered.

In preferred embodiments, said end of the rotor adapted to be secured to the rotatable member comprises a substantially planar end face, and the rotatable member similarly comprises a substantially planar end face.

Such a rotor end face may be of any suitble configuration depending on the construction of the rotor, and will typically be annular or circular.

Similarly, the configuration of the rotatable member may vary as appropriate. Typically this will comprise a circular end plate with a drive shaft extending therefrom and leading to suitable drive means, possibly via a flexible coupling. The rotatable member is conveniently mounted in the machine by means of suitable bearings. These may, for example, be located between a drive shaft as mentioned above, and a machine frame. In an alternative embodiment, the rotatable member includes a cylindrical flange surrounding a drive shaft with one or more large diameter angular contact ball races located between the cylindrical flange and the machine. In one preferred such embodiment, the bearing arrangement comprises a pair of angular contact ball races arranged back to back.

The present invention also includes within its scope a tablet making machine fitted with a rotor in accordance with the invention.

The invention will now be further described, by way of example, with reference to the accompanying drawings.

IN THE DRAWINGS

FIG. 1 is a part-sectional side view illustrating a rotor in accordance with the invention fitted in a tablet making machine; and FIG. 2 is a schematic part-sectional side view illustrating an alternative rotor in accordance with the invention fitted in a tablet making machine.

DETAILED DESCRIPTION OF THE DRAWINGS

Figure 1:
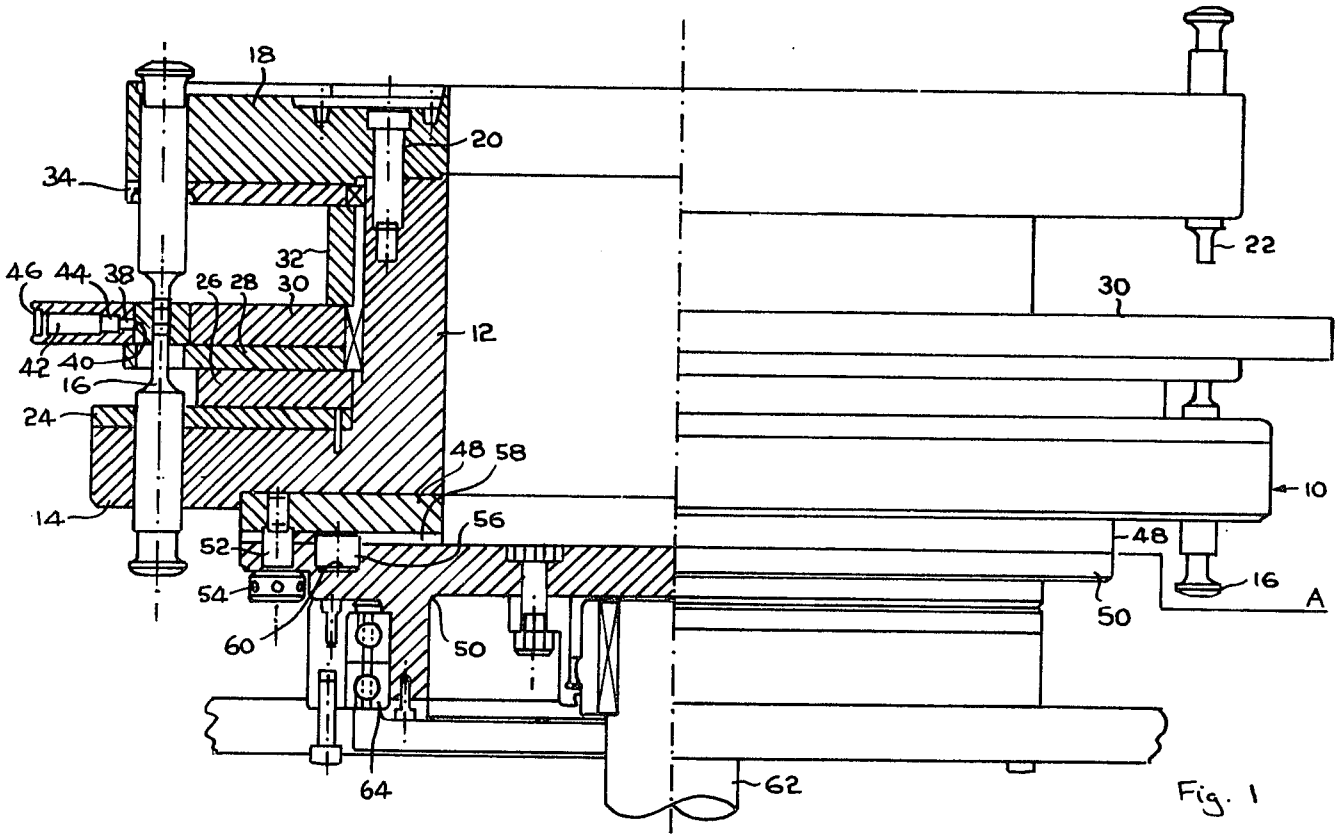

Referring to the drawings, in FIG. 1 there is illustrated a rotor 10 fitted in a tablet making machine.

The rotor 10 comprises a central hub 12 having an outwardly extending flange at the lower end thereof which constitutes an integral lower punch holder 14. The lower punch holder 14 holds a plurality of lower punches 16, typically forty. The lower ends of the punches 16 slide on a lower ramp (not shown).

An upper punch holder 18 is secured by means of shoulder screws 20 to the upper end of the hub 12 and carries a number of upper punches 22 equal to the lower punches 16. The upper ends of the punches 22 similarly slide on an upper ramp (not shown).

A series of further components of the rotor are carried on the hub 12 between the upper and lower punch holders as follows.

A lower cover plate 24 rests on the lower punch holder 14. A cylindrical lower distance piece 26 rests on plate 24, followed by a die support plate 28, a die holder plate 30, an upper distance piece 32 and an upper cover plate 34.

The die holder plate 30 carries a plurality of cylindrical dies 36, the number of these again corresponding to the number of upper and lower punches. Each die is clamped in position in the die holder by means of a shaped plug 38 held against an equatorial groove 40 in the die by a socket head screw 42 acting on an intermediary steel ball 44. The ball 44 prevents any measurable torque being transmitted from the screw 42 to the clamping plug 38. The screws 42 are covered by a rubber band 46 which fits tightly to prevent powder collecting in the recesses but is easily removed for access.

The rotor 10 further comrises a sole plate 48 secured by means of screws to the base of the hub 12. The sole plate is made of tough material, e.g. steel, and is to protect the lower punch holder 14 which is made of cast iron, a relatively soft material which is easily damaged. The sole plate 48 can be easily detached and replaced at small cost if it becomes worn or damaged.

The rotor 10 is shown fitted in a tablet forming machine with the lower end of the rotor secured to a rotor drive plate 50. The rotor drive plate 50 comprises a generally planar upper circular plate with a generally cylindrical flange extending downwardly therefrom. The plate extends outwardly of the cylindrical flange to form an annular attachment flange whereby the plate 50 is detachably secured to the rotor sole plate 48. This is achieved by means of six shoulder screws 52 which extend through bores in the attachment flange of plate 50 into aligned holes in the rotor sole plate 48. As shown, the screws 52 have large knurled heads to facilitate quick attachment and removal by hand. Further, the screw heads include three radial bores 54 for receiving a bar to facilitate attachment and removal.

A pair of locating dowels 56 are provided between the rotor sole plate 48 and drive plate 50, each located in a groove 58 in the rotor sole plate 48 and a recess 60 in the drive plate to assist in correctly locating the rotor with respect to the drive plate during fitting.

The drive plate 50 is fixed in rotation to a drive shaft 62 which is connected by means of a flexible coupling (not shown) to drive means (not shown) for causing rotation of the drive plate 50 and hence of a rotor secured thereto.

The drive plate 50 is supported in the machine by a large diameter being assembly 64 comprising a pair of angular contact ball races arranged back to back, eg Kaydon type KG 120 ARO bearings.

The tablet making machine functions in a manner similar to that described above, with the rotor rotating and the punches moving appropriately to cause compression of powder fed to the dies.

It is clear that the rotor 10 may be easily and readily removed by a simple procedure which involves, inter alia, unscrewing the screws 52 to detach the rotor 10 from the drive plate 50 and sliding the rotor out from the machine in a generally horizontal direction.

Fitting a rotor, eg after cleaning the machine between batches, is an equally simple operation.

Figure 2:
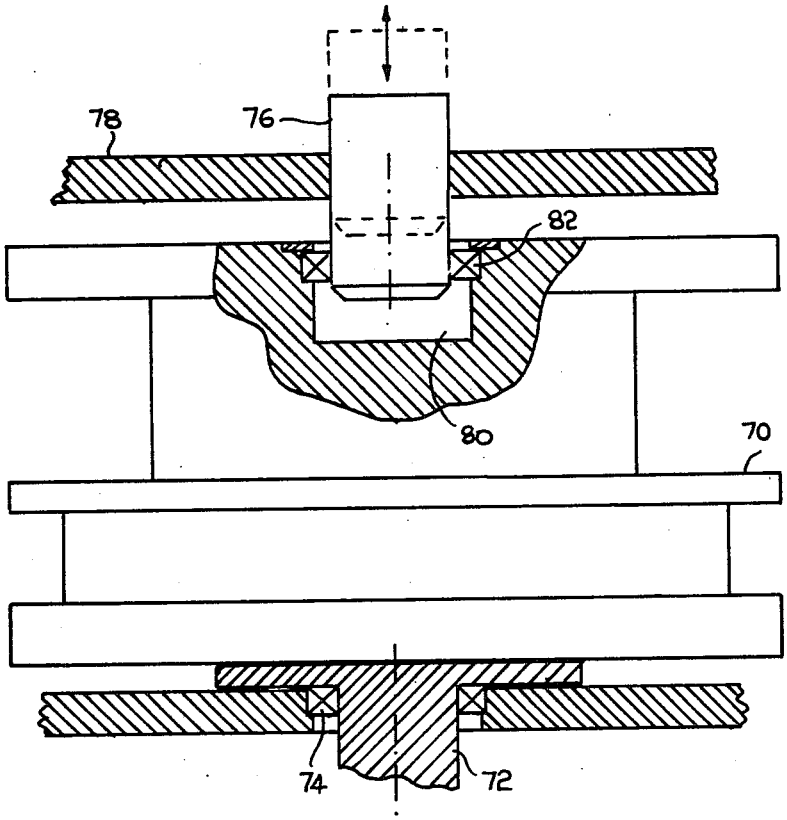

FIG. 2 illustrates schematically an alternative arrangement comprising a rotor 70 generally similar to rotor 10. The lower end face of the rotor 70 is secured to a drive plate 72 by suitable fixing means (not shown), and the drive plate 72 is mounted for rotation in the machine upon bearings 74. The upper end of the rotor is supported within the machine by means of an axially moveble spigot 76 mounted on a frame 78 of the machine. The spigot 76 is moveble between an extended position of use (shown in full lines in the Figure) in which it is located in a recess 80 in the upper end face of the rotor 70, contact between the spigot and rotor being via a bearing 82, and a retracted position (shown in dashed lines in the Figure) in which is withdrawn from the recess 80 so as not to hinder removal of the rotor 70 when desired.

I claim:

1. In a tablet making machine, a rotor one end of which is adapted to be detachably secured to a rotatable member of the machine so that the rotor rotates with the rotatable member in use of the machine; the configuration of the rotor being such that when it is detached from the rotatable member the rotor can be removed from the machine by generally horizontal sliding movement.

2. A machine according to claim 1, wherein the rotor is detachably secured to the rotatable member by means of a plurality of screws passing through suitably located bores in the rotatable member and into aligned holes in the rotor.

3. A machine according to claim 1 further comprising one or more locating dowels for seating in appropriate recesses in the rotor and rotatable member to assist in correctly locating the rotor with respect to the rotatable member during fitting.

4. A machine according to claim 1 wherein the lower end of the rotor is adapted to be detachably secured to the rotatable member.

5. A machine according to claim 1 further comprising a guide for supporting the opposed end of the rotor with respect to the machine.

6. A machine according to claim 5, wherein the guide comprises an axially movable spigot mounted on a frame of the machine, the spigot being movable between an extended position of use in which it is located in a recess in the associated end face of the rotor, contact between the spigot and rotor being via suitable bearing means, and a retracted position in which it is free of the rotor so that removal of the rotor by horizontal sliding is not hindered.

7. A machine according to claim 1 wherein said end of the rotor adapted to be secured to the rotatable member comprises a substantially planar end face, and the rotatable similarly comprises a substantially planar end face.

8. A machine according to claim 7 wherein said rotor end face is of annular or circular configuration.

9. A machine according to claim 1 wherein the rotatable member is mounted in the machine by means of suitable bearings.

10. A machine according to claim 1 wherein the rotatable member includes a cylindrical flange surrounding a drive shaft with one or more large diameter angular contact ball races located between the cylindrical flange and the machine.

* * * * *